US005791510A

United States Patent [19]

Paczonay

[11] Patent Number: 5,791,510

[45] Date of Patent: Aug. 11, 1998

[54] SELF SEALING BITE VALVE

[76] Inventor: Joseph R. Paczonay, 3050 Aptos Hill La., Aptos, Calif. 95003

[21] Appl. No.: 678,585

[22] Filed: Jul. 11, 1996

Related U.S. Application Data

[63] Continuation-in-part of Ser. No. 615,611, Mar. 13, 1996, Pat. No. 5,601,207.

[51] Int. Cl.[6] ..... A45F 3/00

[52] U.S. Cl. ..... 220/714; 220/703; 215/11.4

[58] Field of Search ..... 220/714, 703; 215/11.4; 239/33; 251/342

[56] References Cited

U.S. PATENT DOCUMENTS

| | | | |
|---|---|---|---|
| 2,219,604 | 10/1940 | Trotter . | |
| 3,424,157 | 1/1969 | Dipaolo | 215/11.4 |
| 3,822,720 | 7/1974 | Souza . | |
| 4,993,568 | 2/1991 | Morifuji et al. | 215/11.4 X |
| 5,085,349 | 2/1992 | Fawcett . | |
| 5,301,860 | 4/1994 | Paczonay . | |
| 5,553,726 | 9/1996 | Park | 215/11.4 |
| 5,601,207 | 2/1997 | Paczonay | 220/703 |

*Primary Examiner*—Steven M. Pallard
*Attorney, Agent, or Firm*—Thomas R. Lampe

[57] ABSTRACT

Apparatus for delivering liquid to the mouth of an individual includes a hollow body portion having an inlet end and an outlet having at least one dispensing slit, and structure connected to the hollow body portion exerting forces on the hollow body portion and closure continuously urging the at least one dispensing slit to closed condition.

23 Claims, 4 Drawing Sheets

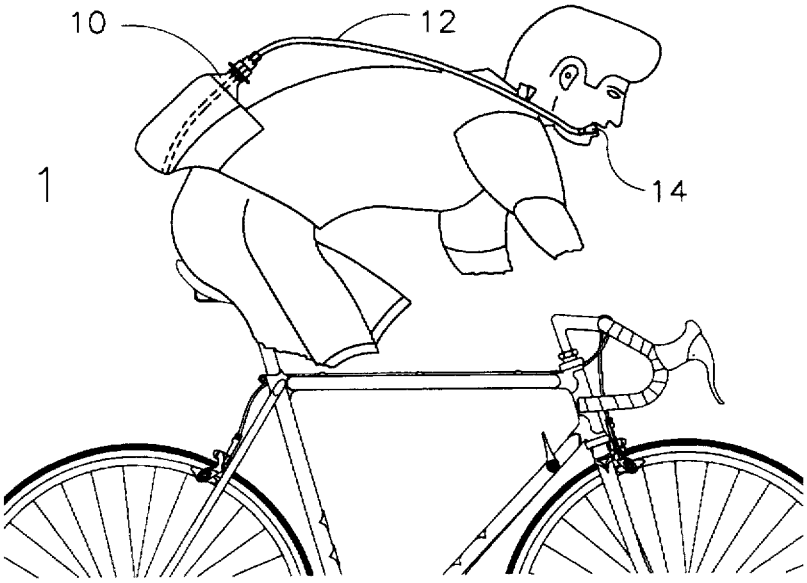
Fig. 1
Fig. 2A
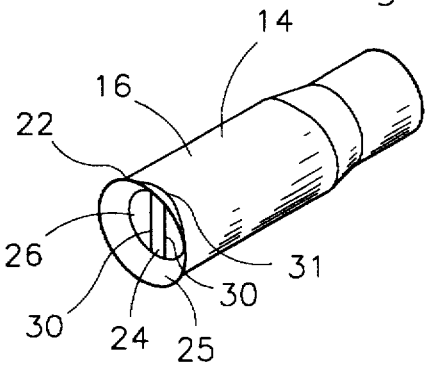
Fig. 2B
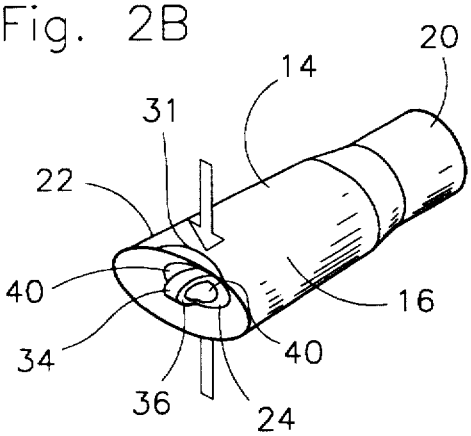
Fig. 2C
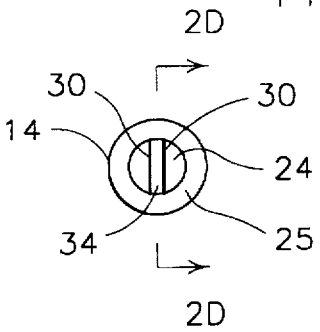
Fig. 2D
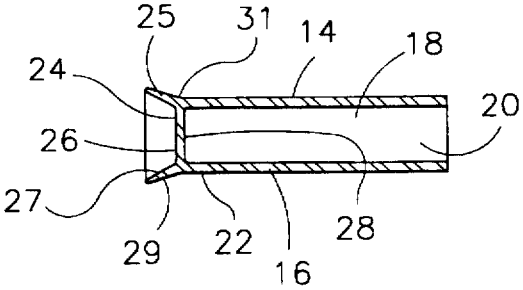

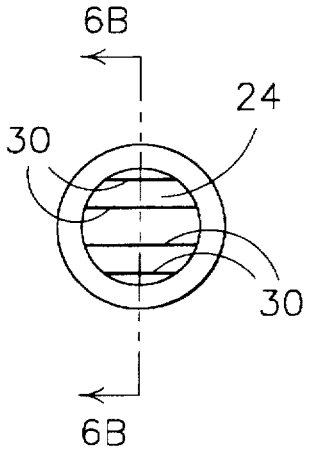
Fig. 6A
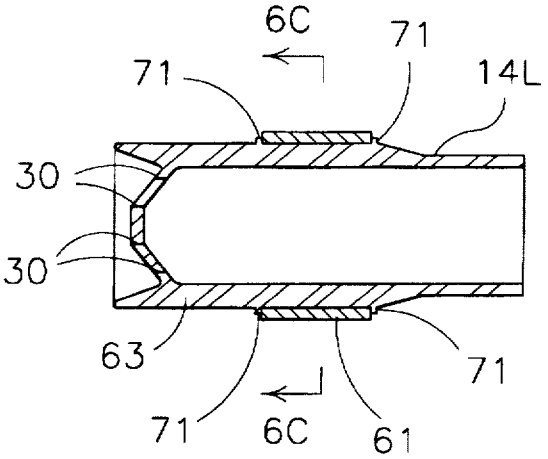
Fig. 6B
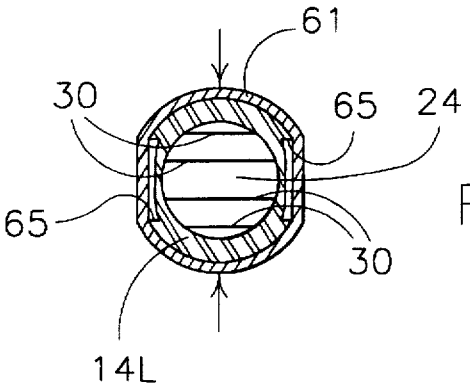
Fig. 6C
Fig. 7B
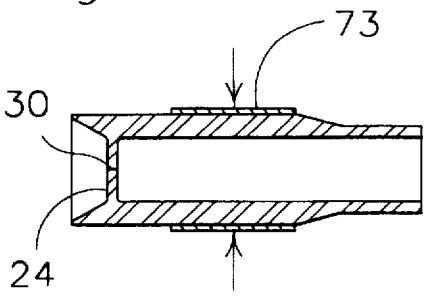
Fig. 7A
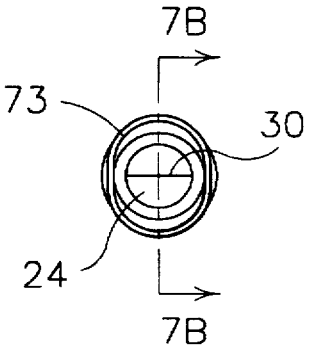

SELF SEALING BITE VALVE

This invention is a continuation-in-part of U.S. application Ser. No. 08/615,611, filed Mar. 13, 1996, now U.S. Pat. No. 5,601,207.

TECHNICAL FIELD

This invention relates to a liquid delivery device for delivering water or other liquids to the mouth of an individual, for example a cyclist.

BACKGROUND ART

My U.S. Pat. No. 5,301,860, issued Apr. 12, 1994, discloses apparatus for dispensing liquid into the mouth of a cyclist. The apparatus includes a container and a delivery tube connected to the container which is held in the mouth of the cyclist.

U.S. Pat. No. 5,085,349, issued Feb. 4, 1992, discloses a system for delivering liquid from a container to a person's mouth employing a deformable valve structure in the nature of a bite valve wherein a slit in the valve structure is opened to permit delivery of the liquid to the person's mouth when the person bites down upon and deforms the valve.

The bite valve of U.S. Pat. No. 5,085,349 incorporates a closure member having a single slit formed therein and a sealing structure on the upstream side of the closure member. Deformation of the valve body by biting thereupon opens the slit only to a limited extent, the closure member walls defining the slit being forced apart essentially in a single plane to create a liquid dispensing orifice. The orifice is relatively restricted and liquid flow impeded to a considerable extent. The sealing structure is essentially in the form of two adjacent wedges and prevents flow when no deforming forces are applied to the valve body. The wedge of material built into the closure member also acts to impede liquid flow. There is no structure at the biting end of the valve to help keep it in the mouth of the user. Thus, this valve can easily fall out of the mouth of the user.

U.S. Pat. No. 2,219,604, issued October, 1940, and U.S. Pat. No. 3,822,720, issued Jul. 9, 1974, disclose devices for dispensing or controlling the flow of liquid which also incorporate a single slit at the point of egress of the liquid controlled or dispensed thereby. In addition, the device in U.S. Pat. No. 3,822,720 has extra material at the point of egress of the liquid which can impede liquid flow. Also, U.S. Pat. No. 2,219,604 incorporates more than one part for closing the valve to liquid flow.

DISCLOSURE OF INVENTION

The present invention relates to apparatus for positioning in the mouth of an individual for selectively delivering liquid from a liquid source for consumption by the individual.

The apparatus of the present invention is formed of resilient, flexible material and includes a hollow body portion defining an interior for accommodating liquid received from a liquid source. The body portion includes a fluid inlet end communicating with the interior for receiving liquid from the liquid source and a fluid outlet end spaced from the fluid inlet end.

A deformable closure is connected to the body portion and extend s across the fluid outlet of the body portion. The closure includes an outer closure wall and an inner closure wall spaced from the outer closure wall and having at least one dispensing slit.

The at least one dispensing slit extends between the outer closure wall and the inner closure wall to maintain the at least one dispensing slit in closed condition to prevent liquid flow through the at least one dispensing slit from the interior.

The closure changes shape upon application of opposed external forces on the apparatus to open the at least one slit and form at least one opening allow ing liquid flow from the interior.

Force exerting means is connected to the hollow body portion for exerting forces on the hollow body portion and the closure for urging the at least one dispensing slit to closed condition.

Other features, advantages, and objects of the present invention will become apparent with reference to the following description and accompanying drawings.

BRIEF DESCRIPTION OF DRAWINGS

FIG. 1 is a side view of a cyclist utilizing apparatus constructed in accordance with the teachings of the present invention;

FIG. 2A is a perspective view of one form of bite valve apparatus constructed in accordance with the teachings of the present invention, the bite valve being closed;

FIG. 2B is a view similar to that of FIG. 2A but illustrating in diagrammatic fashion opposed compressive forces being applied to the bite valve to open the bite valve;

FIG. 2C is an end view of the bite valve of FIG. 2A;

FIG. 2D is a cross-sectional view taken along the line 2D—2D of FIG. 2C;

FIG. 6A is an end view of the outlet end of a fifth bite valve embodiment;

FIG. 6B is a cross-sectional view taken along the line 6B—6B of FIG. 6A;

FIG. 6C is a cross-sectional view taken along the line 6C—6C of FIG. 6B;

FIG. 7A is an end view of the inlet end of a sixth bite valve embodiment; and

FIG. 7B is a cross-sectional view taken along the line 7B—7B of FIG. 7A.

MODES FOR CARRYING OUT THE INVENTION

Figure 3A:
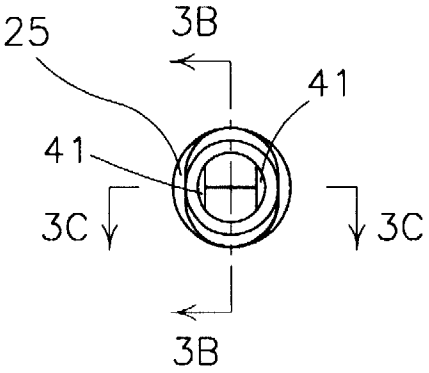
FIG. 3A is an end view of the inlet end of a second embodiment of the bite valve.
Figure 3B:
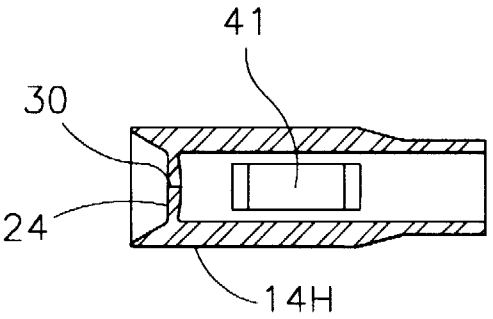
FIG. 3B is a cross-sectional view taken along the line 3B—3B of FIG. 3A.
Figure 3C:
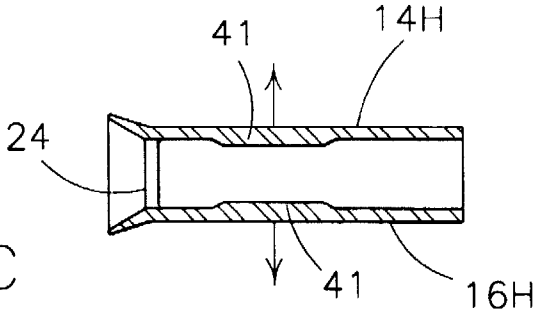
FIG. 3C is a cross-sectional view taken along the line 3C—3C of FIG. 3A.

FIG. 1 illustrates apparatus constructed in accordance with the teachings of the present invention being utilized by the rider of a bicycle. A liquid container 10 is carried on the cyclist's back. A liquid delivery tube 12 projects into the container at one end thereof. The tube extends to the cyclist's mouth as shown. Attached to the end of tube 12 remote from container 10 is bite valve apparatus 14 which is employed to selectively alternately terminate or allow flow of liquid into the cyclist's mouth.

Referring now also to FIGS. 2A, 2B, 2C, and 2D, the bite valve apparatus 14 is shown separated from the tube. Apparatus 14 is of integral instruction and is formed of resilient, flexible material such as rubber or plastic.

Apparatus 14 includes a hollow body portion 16 defining an interior 18 for accommodating fluid received from the liquid delivery tube (the latter not shown in FIGS. 2A through 2D). Body portion 16 includes a fluid inlet end 20 communicating with the interior for receiving liquid from the liquid source and a fluid outlet end 22 spaced from the fluid inlet end.

Integrally connected to the body portion at the fluid outlet end thereof and extending across the fluid outlet end is a deformable closure 24 which normally assumes the configuration shown in FIGS. 2A, 2C, and 2D.

Integrally molded to the fluid outlet end of body portion 16 and extending outwardly away from closure 24 is flared mouth retention member 25. Member 25 has a generally truncated cone shape and defines a passageway for receiving liquid from closure 24 when the closure is open. Member 25 has an inner member wall 27 and an outer member wall 29, said member walls converging in the direction of liquid flow through the apparatus. That is, the inner member wall flares outwardly from the longitudinal axis of the hollow body portion at an angle greater than the angle at which outer member wall 29 flares outwardly from the longitudinal axis of the hollow body portion.

This construction allows the bite valve apparatus to be easily ejected from an injection mold. When bite valve apparatus 14 is being ejected from the mold, fluid outlet end 22 is first pulled out of a cavity in the mold, bite valve apparatus 14 being forced off a core pin (not shown) by pressurized gas. With the flared angle of inner member wall 27 being greater than the flared angle of the outer member wall 29, bite valve apparatus 14 will not shear at the intersection 31 between the member 25 and the hollow body portion 16. As bite valve apparatus 14 is pulled out of the cavity of the mold, the member 25 will be able to flex. As member 25 is being pulled out of its associated cavity section, it will always be leaving a smaller cavity volume for a larger cavity volume.

Flared member 25 serves two purposes insofar as the function of the bite valve apparatus 14 is concerned. First, the external flared wall 29 intersects with the outer wall of hollow body portion 16, making a convenient concentric ridge for the teeth or lips of an individual. Second, flared member 25 acts to apply a compressive hoop stress on the closure 24, thus forcing any slits in closure 24 to remain closed when no external deforming forces are applied to bite valve apparatus 14.

Closure 24 includes an outer closure wall 26 and an inner closure wall 28 parallel to and equally spaced from the outer closure wall.

Two parallel slits 30 are formed in the closure, the slits being spaced from one another and extending between the outer closure wall and the inner closure wall.

A portion 34 of the closure is positioned between the adjacent outer portions of the closure to maintain the slits in closed condition as shown in FIGS. 2A, 2C, and 2D to prevent liquid flow through the slits from the interior 18 of hollow body portion 16.

Portion 34 is in the form of a strip of resilient flexible material integrally connected to the remainder of the closure at opposed strip ends. When a cyclist bites down on the bite valve apparatus as shown by the arrows in FIG. 2B, the opposed forces are generally parallel to the primary axes of the slits 30 and disposed along a first plane.

Application of the opposed forces will deform the closure 24 as shown in FIG. 2B and cause portion or strip 34 to form an outwardly projecting arch between the ends of the portion or strip. The side walls 36 of the strip are displaced outwardly relative to the remainder of the closure to form fluid outlet openings 40 at opposed sides of the strip. These openings allow a substantial flow or amount of liquid to enter the user's mouth.

It will be noted that the outward movement of the strip or portion 34 is along a second plane substantially angularly disposed relative to the plane occupied by the external biting forces. In the embodiment under discussion, the second plane is generally orthogonal relative to the first plane. The closure will return to its normal condition shown in FIG. 2A by removing the biting force. As discussed previously, the member 25 is constantly applying a compress hoop stress that will force the closure 24 into the closed position shown in FIGS. 2A, 2C, and 2D.

Figure 3D:
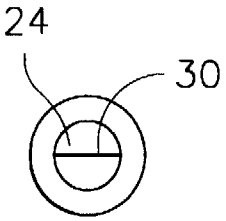
FIG. 3D is an end view of the outlet end of the second embodiment of the bite valve.

FIGS. 3A through 3D illustrate an alternate form of bite valve apparatus 14H. Bite valve apparatus 14H differs from previously described bite valve apparatus 14 in that sections of extra material or projections 41 in the form of longitudinal chord sections of predetermined length are provided on the internal wall of the hollow body portion 16H of bite valve apparatus 14H. There are two such projections and they are spaced from one another and in substantially diametric opposition along the longitudinal axis of a single slit 30 formed in the closure 24. When this embodiment of the bite valve is pressed onto a tube such as tube 12 (FIG. 1), the tube will force the projections 41 outwardly away from one another as indicated by the arrows in FIG. 3C. This will in turn impart a constant tensional stress to the closure 24 that is parallel to the slit or slits. As shown in FIGS. 3A and 3D, this tensional stress will force the slit closed when no outside deforming forces are applied to the bite valve apparatus. In this embodiment the inner wall is concave along the axis of the slit.

Figure 4B:
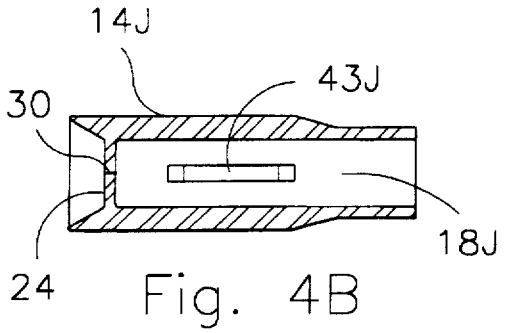
FIG. 4B is a cross-sectional view taken along the line 4B—4B of FIG. 4A.
Figure 4A:
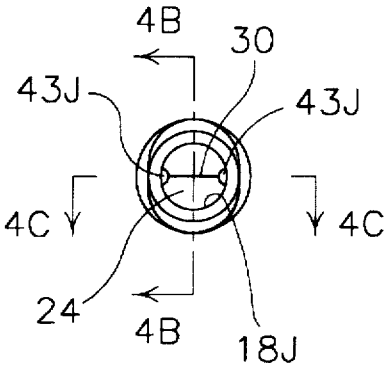
FIG. 4A is a view similar to FIG. 3A but illustrating a third embodiment of the bite valve.
Figure 4C:
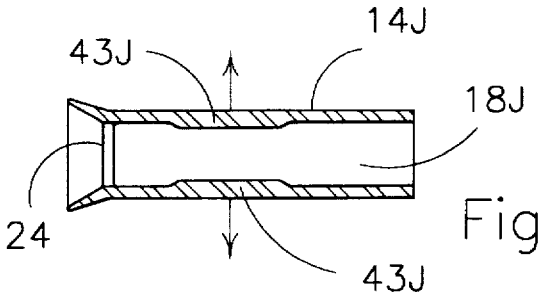
FIG. 4C is a cross-sectional view taken along the line 4C—4C of FIG. 4A.

Referring now to FIGS. 4A through 4C, another embodiment of the bite valve apparatus 14J is shown. In this embodiment, sections of extra material in the form of opposed ribs 43J having generally circular cross sections project inwardly from the internal wall 18J of the bite valve apparatus 14J. When this embodiment of the bite valve is pressed onto a tube, the tube will force the projecting ribs 43J outwardly relative to the remainder of the apparatus as depicted by the arrows in FIG. 4C. This will in turn apply a constant tensional stress to the closure 24 that corresponds to the longitudinal axis of slit 30. As shown in FIG. 4A, this tensional stress will force the slit closed when no deforming biting forces are applied to the bite valve apparatus.

Figure 5B:
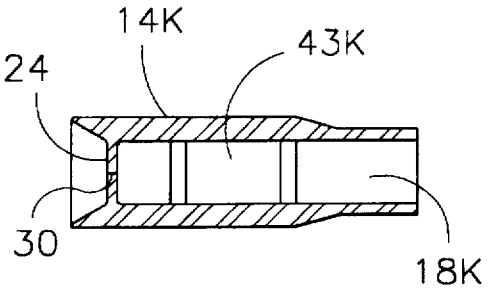
FIG. 5B is a cross-sectional view taken along the line 5B—5B of FIG. 5A.
Figure 5A:
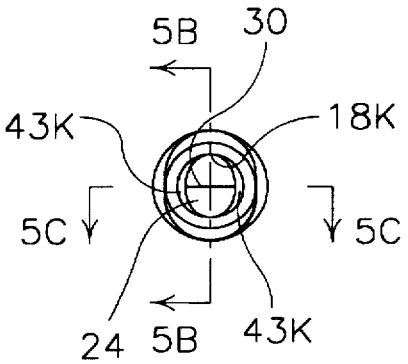
FIG. 5A is a view similar to FIG. 3A but illustrating a fourth embodiment of the bite valve.
Figure 5C:
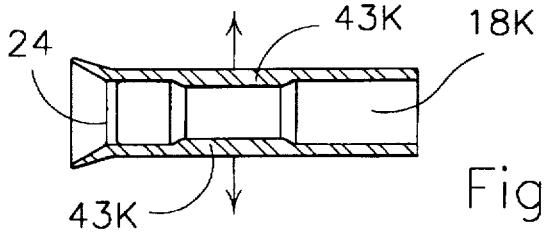
FIG. 5C is a cross-sectional view taken along the line 5C—5C of FIG. 5A.

Bite valve apparatus 14K shown in FIGS. 5A through 5C incorporates elliptical sections 43K comprised of extra material on the internal wall 18K. These elliptical sections too will act to force the slit 30 of closure 24 closed as shown in FIG. 5A.

Instead of applying a force to the internal surface of the bite valve apparatus as in the embodiments described above, the embodiment shown in FIGS. 6A through 6C employs a band 61 surrounding and engaging the external surface of wall 63 of bite valve apparatus 14L. The band 61 can be formed of resilient or rigid material. The band is placed a desired distance from the outlet end of the bite valve.

Containing ridges 71 are provided to maintain the band 61 at the desired distance from the outlet end of the bite valve apparatus. The raised or thicker sections 65 of the wall 63 of the hollow body portion of bite valve apparatus 14L act to keep the inner peripheral wall of band 61 from pressing against the hollow body portion near the ends of the slits 30. Therefore, compressive forces are only applied by the band to the wall 63 of the bite valve apparatus perpendicular to the orientation of slits 30. In other words, the inner peripheral wall of the band is in engagement with the hollow body portion at a first pair of substantially diametrically opposed spaced locations on the hollow body portion and out of engagement with the hollow body portion at a second pair of spaced locations positioned between the first pair of spaced locations. If no external deforming forces are applied to the bite valve, the slits 30 on closure 24 will close as shown in FIGS. 6A and 6C.

The closure illustrated is comprised of a plurality of adjoining closure panels, the straight and parallel slits being located along lines of intersection of adjacent closure panels. The closure projects outwardly in the direction of liquid flow.

FIGS. 7A and 7B show one more embodiment of the bite valve apparatus. In this embodiment a band 73 is made of elastic material such as rubber or plastic. The band 73 is placed at a desired distance from the end of the bite valve apparatus and applies a constant compressive force to the outside surface of the bite valve. Since the cross-section of the bite valve is oval in this embodiment, the compressive force applied by the elastic band is concentrated along a line perpendicular to the slit 30. This will maintain the slit in closed condition as shown in FIG. 7B.

I claim:

1. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end;

a deformable closure connected to said body portion and extending across the fluid outlet end of said body portion, said closure including an outer closure wall and an inner closure wall spaced from said outer closure wall and an inner closure wall spaced from said outer closure wall and having at least one straight dispensing slit formed therein extending alone a longitudinal axis, said at least one dispensing slit extending between said outer closure wall and said inner closure wall and normally closed to prevent liquid flow through said at least one dispensing slit from said interior, said closure changing shape upon application of opposed external forces on said apparatus along said longitudinal axis to open said at least one dispensing slit and form at least one opening allowing liquid flow from said interior; and a mouth retention member affixed to said hollow body portion at the fluid outlet end thereof and defining a passageway for receiving liquid exiting said hollow body portion interior through said at least one dispensing slit and directing the liquid into the mouth of an individual, said mouth retention member being in the general shape of a truncated cone flaring outwardly from said hollow body portion and having a distal end defining an unobstructed liquid exit opening which is larger than the fluid outlet end of said body portion, said mouth retention member exerting stress forces on said hollow body portion and said closure continuously urging said at least one dispensing slit to closed condition and including an outer retention member surface engageable by a user of the apparatus to retain the apparatus in the user's mouth for directly delivering liquid into the user's mouth through the unobstructed liquid exit opening.

2. The apparatus according to claim 1 wherein a plurality of spaced dispensing slits are formed in said closure, at least two of said dispensing slits being at least partially defined by a portion of the closure changing shape upon application of opposed external forces on said apparatus.

3. The apparatus according to claim 1 wherein said mouth retention member includes an inner member wall and an outer member wall, said member walls converging in the direction of liquid flow through said apparatus.

4. The apparatus according to claim 3 wherein said inner member wall flares outwardly from the body portion at a first angle and said outer member wall flares outwardly from the hollow body portion at a second angle, said second angle being smaller than said first angle.

5. The apparatus according to claim 1 wherein said closure is connected to said body portion substantially at the location of affixation of said body portion with said mouth retention member.

6. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end;

a deformable closure connected to said body portion and extending across the fluid outlet end of said body portion, said closure including an outer closure wall and an inner closure wall spaced from said outer closure wall and having at least one straight dispensing slit formed therein extending along a longitudinal axis, said at least one dispensing slit extending between said outer closure wall and said inner closure wall, said closure changing shape upon application of opposed external forces on said apparatus along said longitudinal axis to open said at least one dispensing slit and form at least one opening allowing liquid flow from said interior; and force exerting means connected to said hollow body portion for exerting forces on said hollow body portion and said closure for urging said at least one dispensing slit to closed condition, said force exerting means comprising at least one projection attached to the hollow body portion and projecting into the interior thereof, said at least one projection engageable by a liquid delivery tube positioned in said hollow body portion to be displaced outwardly and cause application of tensional forces on said closure in a direction substantially corresponding to the longitudinal axis of said at least one dispensing slit continuously urging said at least one dispensing slit to closed condition.

7. The apparatus according to claim 6 wherein said force exerting means including a pair of projections projecting into the interior of said hollow body portion, said projections being spaced from one another and in substantially diametric opposition along said slit longitudinal axis to exert opposed tensional forces on said closure.

8. The apparatus according to claim 7 wherein said projections comprise ribs.

9. The apparatus according to claim 7 wherein said projections comprise substantially chord-like members.

10. The apparatus according to claim 7 wherein said projections have elliptically shaped outer surfaces.

11. The apparatus according to claim 6 wherein said at least one projection is integrally formed with said hollow body portion.

12. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end;

a deformable closure connected to said body portion and extending across the fluid outlet end of said body portion, said closure including an outer closure wall and an inner closure wall spaced from said outer closure wall and having at least one dispensing slit formed therein, said at least one dispensing slit extending between said outer closure wall and said inner closure wall, said closure changing shape upon application of opposed external forces on said apparatus to open said at least one dispensing slit and form at least one opening allowing liquid flow from said interior; and force exerting means connected to said hollow body portion for exerting forces on said hollow body portion and said closure for urging said at least one dispensing slit to closed condition, said force exerting means comprising a band spaced from said closure, connected to said hollow body portion, and extending about said hollow body portion, said band including an inner peripheral wall which is in engagement with said hollow body portion at a first pair of substantially diametrically opposed spaced locations on said hollow body portion and out of engagement with said hollow body portion at a second pair of spaced locations positioned between the first pair of spaced locations.

13. The apparatus according to claim 12 wherein said hollow body portion includes a hollow body portion wall defining said interior, said hollow body portion wall being thicker at said first pair of spaced locations than at said second pair of spaced locations.

14. The apparatus according to claim 6 wherein said closure is of substantially uniform thickness.

15. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end; and a deformable closure connected to said body portion and extending across the fluid outlet end of said body portion, said closure including an outer closure wall and an inner closure wall spaced from said outer closure wall and having a plurality of slits formed therein, said plurality of slits being spaced from one another and extending between said outer closure wall and said inner closure wall, and at least one portion of said closure being located between and defined by said plurality of slits and cooperating with the remainder of said closure to maintain said slits in closed condition to prevent liquid flow through said slits from said interior, said at least one portion changing shape upon application of opposed external forces on said apparatus to open said plurality of slits and form a plurality of openings allowing liquid flow from said interior, said closure being comprised of a plurality of closure panels and said slits being located along lines of intersection of adjacent closure panels, said closure projecting outwardly in the direction of liquid flow.

16. The apparatus according to claim 15 additionally comprising a band extending about said hollow body portion and connected thereto at a location spaced from said closure for applying compressive forces on said hollow body portion, said slits being generally straight and parallel and the compressive forces applied to said hollow body portion by said band being substantially orthogonal to the slits.

17. The apparatus according to claim 6 wherein said inner closure wall is curved over at least a portion thereof.

18. The apparatus according to claim 1 wherein said inner closure wall is curved over at least a portion thereof.

19. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end;

a deformable closure connected to said body portion and extending across the fluid outlet end of said body portion, said closure including an outer closure wall and an inner closure wall spaced from said outer closure wall and having at least one dispensing slit formed therein, said at least one dispensing slit extending between said outer closure wall and said inner closure wall and normally closed to prevent liquid flow through said at least one dispensing slit from said interior, said closure changing shape upon application of opposed external forces on said apparatus to open said at least one dispensing slit and form at least one opening allowing liquid flow from said interior; and a mouth retention member affixed to said hollow body portion at the fluid outlet end thereof and defining a passageway for receiving liquid exiting said hollow body portion interior through said at least one dispensing slit and directing the liquid into the mouth of an individual, said mouth retention member flaring outwardly from said hollow body portion and exerting forces on said hollow body portion and said closure urging said at least one dispensing slit to closed condition and including an outer retention member surface engageable by a user of the apparatus to retain the apparatus in the user's mouth, said mouth retention member including an inner member wall and an outer member wall, said member walls converging in the direction of liquid flow through said apparatus, said inner member wall flaring outwardly from the body portion at a first angle and said outer member wall flaring outwardly from the hollow body portion at a second angle, said second angle being smaller than said first angle.

20. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end;

a deformable closure connected to said body portion and extending across the fluid outlet end of said body portion, said closure including an outer closure wall and an inner closure wall spaced from said outer closure wall and having at least one dispensing slit formed therein, said at least one straight dispensing slit extending along a slit longitudinal axis and extending between said outer closure wall and said inner closure wall, said closure changing shape upon application of opposed external forces on said apparatus to open said at least one dispensing slit and form at least one opening allowing liquid flow from said interior; and force exerting means connected to said hollow body portion for exerting forces on said hollow body portion and said closure for urging said at least one dispensing slit to closed condition, said force exerting means comprising a pair of projections attached to the hollow body portion and projecting into the interior thereof, said projections engageable by a liquid delivery tube positioned in said hollow body portion to be displaced outwardly and cause application of tensional forces on said closure urging said at least one straight dispensing slit to closed condition, said projections being spaced from one another and in substantially diametric opposition along said slit longitudinal axis to exert opposed tensional forces on said closure.

21. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from the liquid source and a fluid outlet end spaced from said fluid inlet end;

a deformable closure connected to said body position and extending across the fluid outlet end of said body portion, said closure including an outer closure wall and an inner closure wall spaced from said outer closure wall and having at least one dispensing slit formed therein, said at least one dispensing slit extending between said outer closure wall and said inner closure wall, said closure changing shape upon application of opposed external forces on said apparatus to open said at least one dispensing slit and form at least one opening allowing liquid flow from said interior; and force exerting means connected to said hollow body portion for exerting forces on said hollow body portion and said closure for urging said at least one dispensing slit to closed condition, said force exerting means comprising a band spaced from said closure, connected to said hollow body portion, and extending about said hollow body portion, said band being formed of rigid material.

22. Apparatus for positioning in the mouth of an individual for selectively delivering liquid from a liquid source for consumption by the individual, said apparatus being formed of resilient, flexible material, and comprising, in combination:

a hollow body portion defining an interior for accommodating fluid received from a liquid source, said body portion including a fluid inlet end communicating with said interior for receiving liquid from a liquid source and a fluid outlet end spaced from said fluid inlet end;

a deformable closure connected to said body portion and extending across the fluid outlet end of said body portion, said closure including an outer closure wall and an inner closure wall spaced from said outer closure wall and having at least one dispensing slit formed therein, said at least one dispensing slit extending between said outer closure wall and said inner closure wall, said closure changing shape upon application of opposed external forces on said apparatus to open said at least one dispensing slit and form at least one opening allowing liquid flow from said interior; and force exerting means connected to said hollow body portion for exerting forces on said hollow body portion and said closure for urging said at least one dispensing slit to closed condition, said force exerting means comprising a band spaced from said closure, connected to said hollow body portion, and extending about said hollow body portion, said band including an inner peripheral wall which is in engagement with said hollow body portion at at least one location on said hollow body portion and out of engagement with said hollow body portion at at least one other location on said hollow body portion, wherein said band is formed of a substantially rigid material.

23. The apparatus according to claim 22 wherein said band is formed of resilient material.

* * * * *